US007922869B2

(12) United States Patent
Ishino

(10) Patent No.: US 7,922,869 B2
(45) Date of Patent: Apr. 12, 2011

(54) SHOE PRESS BELT

(75) Inventor: Atsushi Ishino, Tokyo (JP)

(73) Assignee: Ichikawa Co., Ltd., Tokyo (JP)

( * ) Notice: Subject to any disclaimer, the term of this patent is extended or adjusted under 35 U.S.C. 154(b) by 488 days.

(21) Appl. No.: 11/992,537

(22) PCT Filed: Sep. 27, 2006

(86) PCT No.: PCT/JP2006/319811

§ 371 (c)(1),
(2), (4) Date: Mar. 25, 2008

(87) PCT Pub. No.: WO2007/037495

PCT Pub. Date: Apr. 5, 2007

(65) Prior Publication Data

US 2009/0266502 A1 Oct. 29, 2009

(30) Foreign Application Priority Data

Sep. 27, 2005 (JP) ..... 2005-280103
Nov. 2, 2005 (JP) ..... 2005-319091

(51) Int. Cl.
*D21F 3/02* (2006.01)

(52) U.S. Cl. ..... 162/358.4; 162/901

(58) Field of Classification Search ..... 162/306, 162/358.4, 901, 358.3; 428/163, 167; 442/59, 442/148, 64–67, 71; 528/59–66
See application file for complete search history.

(56) References Cited

U.S. PATENT DOCUMENTS

2004/0029474 A1 2/2004 Watanabe et al.
2006/0191658 A1 8/2006 Watanabe et al.

FOREIGN PATENT DOCUMENTS

EP 1 338 696 8/2003
EP 1338696 A1 * 8/2003

OTHER PUBLICATIONS

International Search Report mailed Dec. 21, 2006 in International Application PCT/JP2006/319811.

* cited by examiner

*Primary Examiner* — Eric Hug
(74) *Attorney, Agent, or Firm* — Wenderoth, Lind & Ponack, L.L.P.

(57) ABSTRACT

A shoe press belt for a paper machine includes a substrate and a polyurethane resin impregnated to laminate on the surfaces of both the shoe side and the felt side thereof, and is excellent in abrasion resistance, crack resistance and processability. A polyurethane resin is produced by using a combination of two kinds of diisocyanates, that is, tolylene diisocyanate (TDI) and diphenylmethane diisocyanate (MDI) as starting materials.

20 Claims, 2 Drawing Sheets

SHOE PRESS BELT

TECHNICAL FIELD

The present invention relates to a shoe press belt for a paper machine.

BACKGROUND ART

In a dehydrating step for making paper, a pressure belt is used in a press part to press a wet paper to dehydrate it. As the pressure belt, a shoe press belt that rotates to press against a press roller from a pressing shoe side is often used. The belt running between the press roller and the pressing shoe of a papermaking machine is pressed together with the felt and the wet paper placed on the belt through the shoe press mechanism of the papermaking machine to squeeze and transfer moisture contained in the wet paper into the felt.

In order to increase the strength of whole the belt, the shoe press belt basically comprises a substrate made of a woven fabric and a polyurethane laminated on one side or both sides of the substrate.

The polyurethane is prepared as follows. At first, diisocyanate having two isocyanate groups at its ends and a polyol having one or more hydroxyl groups at its ends are addition-polymerized to give a urethane prepolymer having isocyanate groups at its ends. The liquid urethane prepolymer thus obtained, which has a low molecular weight, is supplied with a curing agent (chain extender) followed by heating to cure, thereby providing a high molecular weight of a solid polyurethane.

In order to produce such a belt laminated with the polyurethane, the liquid urethane prepolymer containing a curing agent is coated on a substrate, impregnated, and then dried or heated to cure.

As the above-mentioned diisocyanate which is a starting material of the urethane prepolymer, tolylene diisocyanate (hereinafter referred to as "TDI") is often used, and diphenylmethane diisocyanate (hereinafter referred to as "MDI") is also used. In addition, it is proposed that MDI and TDI are used as starting materials of the polyurethanes on a shoe side and on a felt side, respectively (Patent Document 1).

[Patent Document 1]

Japanese Patent Application Laid-Open No. 2002-146694

DISCLOSURE OF THE INVENTION

Problem to be Solved by the Invention

The shoe press belt, which is used under a severe condition of running at a high speed under a high pressure loaded by the pressing shoe and the press roller, is susceptible to abrasion and cracking. Further, the shoe press belt has usually a number of drainage grooves on the felt side along the running direction to drain squeezed moisture. The drainage grooves are liable to deform and are susceptible to fracture in the edges (land edges). Consequently, in order to withstand a long term application, the polyurethane resin, which is a raw material of the shoe press belt, is required to have abrasion resistance and crack resistance under such a condition.

The present inventors have found that a polyurethane resin produced by using a combination of diisocyanates TDI and MDI as staring materials, that is: (1) a polyurethane resin obtained from a mixed urethane prepolymer of a TDI prepolymer which is obtained by reacting TDI with a polyol and an MDI prepolymer which is obtained by reacting MDI with a polyol; or (2) a polyurethane resin obtained from a urethane prepolymer which is obtained by reacting a mixture of TDI and MDI with a polyol. The starting materials are used for both sides (the shoe side and the felt side) of a substrate fabric, wherein the polyurethanes on both side of the belt are adjusted to have their optimum mixing ratios of the diisocyanates, which provides remarkable improvement of physical properties such as abrasion resistance and crack resistance to give a suitable belt for a papermaking machine.

Means for Solving the Problem

The first embodiment of the present invention is a shoe press belt comprising a substrate and a polyurethane resin impregnated to laminate on the surfaces of both the shoe side and the felt side thereof, wherein the polyurethane resin on both sides is obtained by reacting a mixed prepolymer of a TDI prepolymer which is obtained by reacting tolylene diisocyanate (TDI) with a polyol and has an isocyanate group at the end and an MDI prepolymer which is obtained by reacting diphenylmethane diisocyanate (MDI) with a polyol and has an isocyanate group at the end, with a curing agent; and the TDI prepolymer and the MDI prepolymer are mixed at such a ratio that the polyurethane resin on the shoe side has a higher MDI molar content than the polyurethane resin on the felt side.

Further, the second embodiment of the present invention is a shoe press belt comprising a substrate and a polyurethane resin impregnated to laminate on the surfaces of both the shoe side and the felt side thereof, wherein the polyurethane resin is obtained by reacting a urethane prepolymer which is obtained by reacting a mixture of tolylene diisocyanate (TDI) and diphenylmethane diisocyanate (MDI) with a polyol and has an isocyanate group at the prepolymer end, with a curing agent; and the TDI and the MDI are mixed at such a ratio that the polyurethane resin on the shoe side has a higher MDI molar content than the polyurethane resin on the felt side.

In any of embodiments of the method (1) wherein the mixed prepolymer of the TDI prepolymer and the MDI prepolymer is used and the method (2) wherein the mixed diisocyanate of TDI and MDI is used, the TDI and MDI in the mixture have such a ratio that the polyurethane resin on the shoe side has preferably a MDI molar content of 60 to 95%, particularly 70 to 90%, while the polyurethane resin on the felt side has preferably a MDI molar content of 5 to 50%, particularly 10 to 40%.

Effect of the Invention

For production of a shoe press belt having polyurethane layers on both sides of a substrate, TDI prepolymer/MDI prepolymer mixtures on the shoe side and the felt side having their respective specific molar contents, or TDI/MDI diisocyanate mixtures as the starting materials on the shoe side and the felt side having their respective specific molar contents are used, providing a shoe press belt which is excellent in crack resistance, abrasion resistance and processability compared with conventional ones.

DETAILED DESCRIPTION OF THE INVENTION

Figure 1:
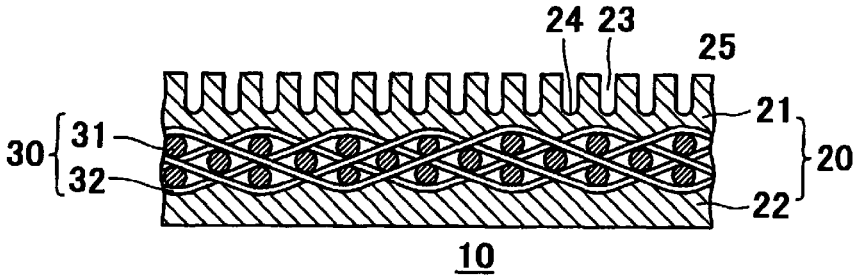
FIG. 1 shows cross-sectional view of a shoe press belt in accordance with the present invention.

The shoe press belt of the present invention has a laminate structure wherein both sides of a substrate are impregnated with polyurethanes to laminate. Woven fabric is mainly used for the substrate.

In order to laminate the polyurethane on the substrate, the substrate is coated and impregnated with the liquid urethane prepolymer containing a curing agent, followed by drying or heating to cure. A high molecular weight of the polyurethane is laminated in a solid state.

In the present invention, for using TDI and MDI in combination, two methods can be carried out: (1) a first method wherein TDI and MDI are separately reacted with a polyol to give a TDI prepolymer and a MDI prepolymer, which are then mixed at a specific molar content to give a TDI prepolymer/MDI prepolymer mixture to use, and (2) another method wherein a TDI/MDI mixture having a specific molar content is used as a diisocyanate starting material for producing a prepolymer.

The shoe press belt has a structure wherein both sides (the shoe side and the felt side) of the substrate are laminated with polyurethane layers. The shoe side and the felt side need to have their respective different physical properties, and thus require selecting their respective best materials. On the other hand, the curing time for curing a prepolymer to produce a high molecular weight of polyurethane depends remarkably on the kind of diisocyanate selected. Accordingly, the molar content of the TDI prepolymer/MDI prepolymer and the molar content of the TDI/MDI used in the polyurethane layer on both sides of the substrate are determined out of comprehensive consideration for the requirements as described above.

According to the present invention, the shoe side of the substrate is first impregnated with polyurethane to form a laminated layer. The substrate is permeated by liquid, and thus attention needs to be paid to the sag of the liquid. Namely, it is important that the shoe side is coated with the liquid urethane prepolymer containing a curing agent to cure in as short a time as possible, to thereby avoid the liquid sag. MDI is effectively added to achieve the end. TDI is cured in a relatively long time, and thus is coated on the shoe side of the substrate to be liable to liquid sag, thereby hardly to laminate. The present invention can solve the problem in that MDI or a MDI prepolymer is added at such a rate that a TDI prepolymer/MDI prepolymer may have a molar content of an adjusted range or a TDI/MDI may have a molar content of an adjusted range. If the MDI prepolymer or the MDI is mixed at too large a rate, the liquid urethane prepolymer containing a curing agent after being coated is cured so instantly that the cured layer cannot be prepared with sufficient adhesion to a fresh layer of urethane prepolymer to laminate any more.

Then, the felt side of the substrate is impregnated with polyurethane to laminate. In this stage, after the polyurethane layer on the shoe side is sufficiently dried to solidity, the belt is turned inside out, and subsequently the felt side of the substrate is impregnated with polyurethane to form a laminated layer. Since the polyurethane layer has been already formed on the shoe side, the belt substrate is not permeated by liquid. Thus, the MDI molar content is mainly adjusted to satisfy the functions required for the resin of the felt side, i.e., the crack resistance and the abrasion resistance. The MDI molar content, if it is high, improves crack resistance, but, if it is too high, undesirably lowers abrasion resistance. As such, according to the present invention, it is crucial that the polyurethane layer on the felt side should be laminated to get good abrasion resistance by the TDI component as well as good crack resistance by the MDI component.

Taking account of the physical properties as mentioned above, for the shoe press belt of the present invention, the polyurethane layers on both sides of the substrate have their respective different molar contents of TDI and MDI, and TDI and MDI are mixed at such a ratio that the shoe side has a higher MDI molar content than the felt side.

In general, the felt side is required to have both crack resistance and abrasion resistance. In accordance with the present invention, in order to produce the polyurethane resin on the felt side, the mixed prepolymer of TDI prepolymer/MDI prepolymer or the mixed diisocyanate of TDI/MDI is preferably adjusted to have an MDI molar content of 5 to 50%, more preferably 10 to 40%, allowing improvement of the felt side in both crack resistance and abrasion resistance. Too high an MDI molar content lowers abrasion resistance. On the other hand, too low an MDI molar content easily causes cracks.

In addition, when the shoe side of the substrate is impregnated with the polyurethane to form the laminated layer, it is important that the curing time is shortened to avoid liquid sag. The addition of MDI is effective for this end. According to the present invention, the mixed prepolymer or the mixed diisocyanate used to produce the polyurethane resin on the shoe side are adjusted to have a higher MDI molar content than that on the felt side, preferably an MDI molar content of 60 to 95%, and more preferably 70 to 90%, allowing shortening a curing time in the shoe side, thereby avoiding liquid sag. Too low an MDI molar content causes liquid sag, resulting in bad processability. On the other hand, too high an MDI molar content easily causes delamination.

MDI has various isomers, and 4,4'-isomer is the most preferable.

As the polyol to be reacted with the mixture of TDI and MDI, a polyether polyol or a polyester polyol can be used. Examples of the polyether polyol may include polyethylene glycol (PEG), polypropylene glycol (PPG), and polytetramethylene glycol. Examples of the polyester polyol may include phthalate polyester polyol, polyethylene adipate, polycaprolactam ester, polycarbonate, polyethylene adipate, and polybutylene adipate. These polyols have preferably an average molecular weight of 200 to 10,000, particularly preferably 400 to 4,000. They may be used alone or in combination of the two or more kinds.

In a reaction for producing the urethane prepolymer, the polyol and the diisocyanate are mixed to have an isocyanate group/OH group equivalent ratio of 1.3/1 to 4/1, and preferably 1.4/1 to 1.6/1.

The thus obtained urethane prepolymer having an isocyanate group at the end has generally a low viscosity, and the prepolymer is subject to chain extension by a curing agent (chain extender) to give a polyurethane with a high molecular weight. In order, to manufacture the belt for paper making machines of the present invention, which consists of the polyurethanes and the substrate, a mixture of the urethane prepolymer and a curing agent is impregnated into the belt substrate such as a woven fabric, heated and cured to produce a belt in which the substrate is impregnated with the polyurethane resins to form laminates on both sides, as shown in FIG. 1.

In FIG. 1, a belt 10 consists of a substrate 30 for giving strength and a polyurethane 20; the polyurethane 20 is laminated to sandwich the substrate 30 between a resin 21 on the felt side contacting wet paper or paper and a resin 22 on the shoe side contacting a paper making machine such as a shoe. As the substrate 30, a woven fabric is used in FIG. 1, wherein the woven fabric is woven with yarn materials 31 in the MD direction and yarn materials 32 in the CMD direction. In addition to the fabric, a nonwoven fabric wherein both yarn materials are not woven but overlapped, a film, a knit, a strip with a narrow belt winding spirally, and the like may also be used. Preferably, drainage grooves 23 are formed in the surface of the felt side resin 21 (the outer circular surface of the belt).

Such drainage grooves, however, are liable to cracks while the belt for paper making machine is working. In order to prevent crack generation, a high MDI molar content is effective, but it has been found from experiments that too high an MDI molar content leads to poor abrasion resistance. According to the present invention, the polyurethane-resin on the felt side is adjusted to have an MDI molar content as specified by the present invention, allowing comprehensive improvement of both physical properties. Therefore, the mixed isocyanate is also extremely effective for the shoe press belt with drainage grooves.

As the drainage groove, in addition to a rectangular groove, a groove having a curved side wall, a groove extending outward, and a groove having a flat bottom and round edges, as described in U.S. Pat. No. 6,296,738 and Utility Model Gazette No. 3,104,830, may be suitably used. In the present invention, a groove having a rectangular cross section and a round bottom, or a groove having a trapezoidal cross section, a round bottom, and chamfered edges in its land parts, as shown in FIGS. 1 and 2, is particularly preferable.

Figure 2:
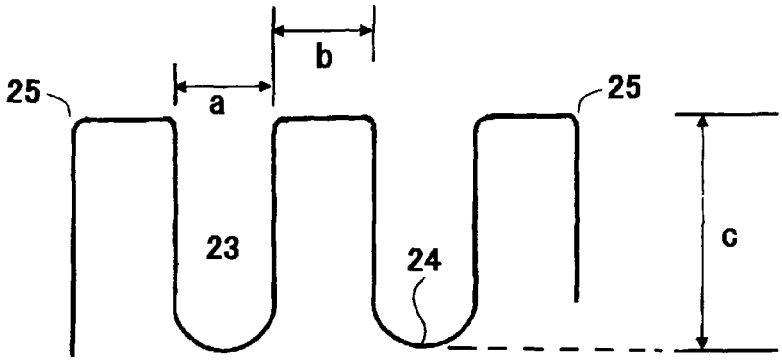
FIG. 2 shows a cross-sectional view of drainage grooves.

FIG. 2 shows the damage grooves having such a form in detail. In FIG. 2, the numeral 23 depicts a rectangular drainage groove, and a number of the grooves are provided in parallel to the moving direction of the belt. The bottom part thereof has a round shape as shown by the numeral 24. The edge of the land part 25 can be chamfered, thereby preventing the edge from being broken and the land from being chipped.

The drainage groove has preferably a width a of 1 to 4 mm, a depth c of 0.5 mm to 5 mm, and an interval b of 1 to 4 mm in common with the neighboring drainage groove. The drainage groove is selected to have such shape and size as mentioned above, and the polyurethane resin on the felt side is selected to have an adjusted MDI, molar content, allowing improvement of physical properties of the polyurethane resin on the felt side.

The curing agents used in the present invention are not particularly limited. Diamine base curing agents, particularly dimethyl-thio-toluenediamine (DMTDA) and methylenebis (o-chloroaniline) (MBOCA) such as 3,3'-dichloro-4,4'-diaminodiphenylmethane can be exemplified, and DMTDA is particularly preferable. DMTDA has various isomers depending on the substitution positions of dimethyl-thio group and amino group, such as 3,5-dimethyl-thio-2,4-toluenediamine, and 3,5-dimethyl-thio-2,6-toluenediamine, and the mixture thereof may be used, which is available from Arbemarle Corporation, USA, under a trademark "Ethacure 300."

The curing reaction using the curing agent can be carried out by known methods. The curing temperature is usually 20 to 150.degree. C., preferably 90 to 140.degree. C., and the reaction is preferably carried out for at least 30 minutes.

The urethane prepolymer and the curing agent are desirably mixed at an equivalent ratio of 0.9 to 1.10, as shown by the active hydrogen of the curing agent versus the isocyanate group of the urethane prepolymer.

Woven fabric, non-woven fabric, film and the like are used as the substrate, and the woven fabric is particularly preferable. Two or more kinds of substrates which are different in material and/or structure may be laminated to use as the substrate.

Figure 3:
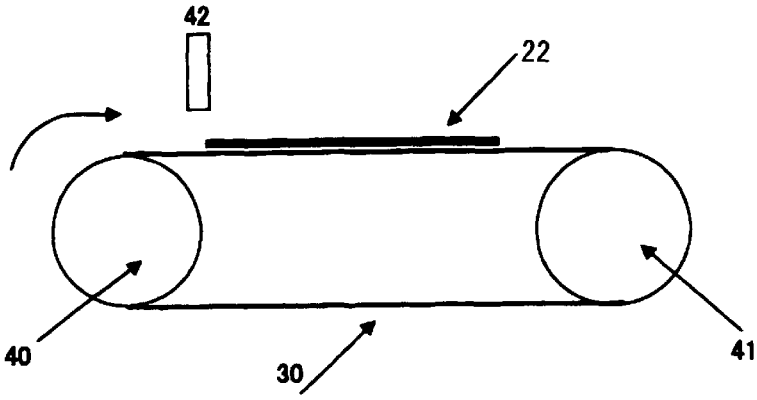
FIG. 3 shows a process for manufacturing a shoe press belt in accordance with the present invention.

The shoe press belt has the polyurethane resin layers laminated on both sides of the substrate. As the method for laminating the polyurethane resin on both sides of the substrate, there is exemplified a method as shown in FIG. 3, wherein a substrate 30 is installed to bridge between rollers 40 and 41, and one side of the substrate is coated with one urethane prepolymer from a coating nozzle 42 while the rollers are rotated to give a shoe side resin layer 22, which is then dried to solidify; then, the substrate is turned inside out; and finally another side is coated with another urethane prepolymer to give a felt side resin layer 21, which is then dried to solidify.

Figure 4:
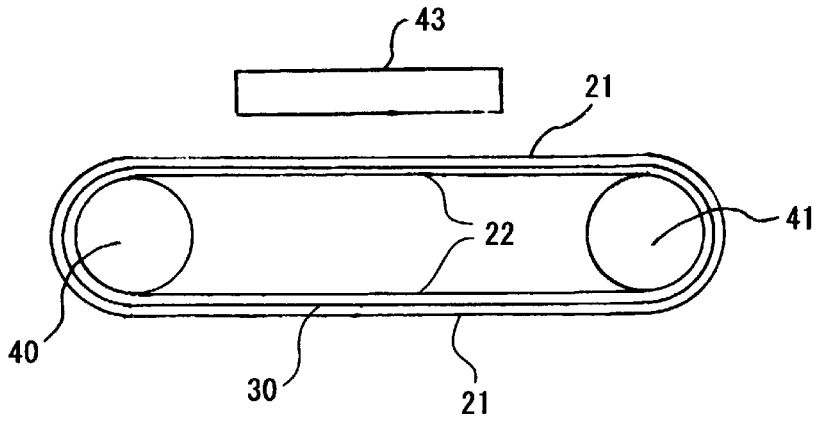
FIG. 4 shows a process for manufacturing a shoe press belt in accordance with the present invention.

As shown in FIG. 4, the belt, which is installed to bridge between the rollers 40 and 41 and has urethane prepolymer layers 22 and 21 impregnated in both sides (the shoe side and felt side) of the substrate 30, is heated by an upper heat source 43 for several hours to react and cure the resins. After the resins are cured, the belt surfaces are abraded, and, if necessary, the outer circular surface, that is, the felt side resin layer 21 is furnished with drainage grooves 23 in FIG. 1 to form. In the present invention, the drainage groove 23 has preferably a rectangular cross-section, a round bottom and a chamfered land edge, or a trapezoidal cross-section, a round bottom and a chamfered land edge. Such a shape of the drainage groove can be designed depending on the shape of a grooving cutter. Also, the width, the depth, and the interval in common with the neighboring drainage groove of a drainage groove can be set to have their respective desirable numerical values depending on the shape of a grooving cutter.

EXAMPLE

The shoe press belt was manufactured by using a mixture of TDI prepolymer/MDI prepolymer or a TDI/MDI mixed diisocyanate according to the present invention as a starting material, and the physical properties thereof were evaluated. The structure of the shoe press belt used in Examples is as shown in FIG. 1.

(Production of a Urethane Prepolymer)

TDI and MDI were each mixed with polytetramethylene glycol to have an NCO/OH equivalent ratio of 1.5/1, put in a reaction vessel filled with nitrogen, and reacted under stirring at 50.degree. C. for 3 hours. The reaction nature was distilled to remove unreacted isocyanate, and the residue was filtered to give a TDI prepolymer or an MDI prepolymer. Both the prepolymers were mixed at a predetermined molar ratio to give a mixture of TDI prepolymer/MDI prepolymer.

On the other hand, TDI and MDI were mixed at a predetermined molar ratio to give a TDI/MDI mixed diisocyanate, which was reacted with polytetramethylene glycol to produce a urethane prepolymer in the same manner as in the production of the TDI prepolymer or the MDI prepolymer mentioned above.

(Addition of a Curing Agent)

DMTDA ("Ethacure 300" (an 80 parts/20 parts mixture of 3,5-dimethyl-thio-2,4-toluenediamine/3,5-dimethyl-thio-2,6-toluenediamine-) made by Arbemarle Corporation, USA) was prepared as a curing agent, which was mixed with the mixed prepolymer or the prepolymer obtained from the mixed diisocyanate, obtained in the previous step, to have an H/NCO equivalent ratio of 0.97.

(Coating the Prepolymer)

As shown in FIG. 3, a substrate 30 was installed to bridge between rollers 40 and 41, and firstly one side of the substrate was coated with one urethane prepolymer from a coating nozzle 42 while the rollers were rotated to give a shoe side resin layer 22, which was then dried to solidify; then, the substrate was turned inside out; and finally another side was coated with another urethane prepolymer to give a felt side resin layer 21, which was then dried to solidify.

(Curing)

As shown in FIG. 4, the belt, which was installed to bridge between the rollers 40 and 41 and had urethane prepolymer layers 22 and 21 impregnated in the both sides (the shoe side and felt side) of the substrate 30, was heated by an upper heat source 43 at 100.degree. C. for 3 hours, then 130.degree. C. for 5 hours to react and cure the resins. After the resins were cured, the belt surfaces were abraded, and further the outer circular surface, that is, the felt side resin layer 21 was furnished with drainage grooves 33 which had a rectangular cross-section, a width of 1 mm and a pitch of 2.5 mm. Thus, there was provided a belt sample which had a thickness of 5 mm and consisted of the polyurethane and the substrate.

With respect to the obtained belt sample, the following physical properties were evaluated.

(1) processability (liquid sag) (2) delamination (3) crack test (4) abrasion test The evaluations method of the physical properties were as follows:

Processability (Liquid Sag)

A rotating roller was installed with a substrate, on which a urethane prepolymer was coated, when the sagging of the resin liquid was observed. The criteria are as follows:

No liquid sagging: good processability Liquid sagging: bad processability

Delamination

A cut was made on an interface between a resin formed on a shoe side and a resin formed on a felt side, and pulled by a stretch tester to tear, against which a maximum strength was measured.

Crack Resistance Test

Figure 5:
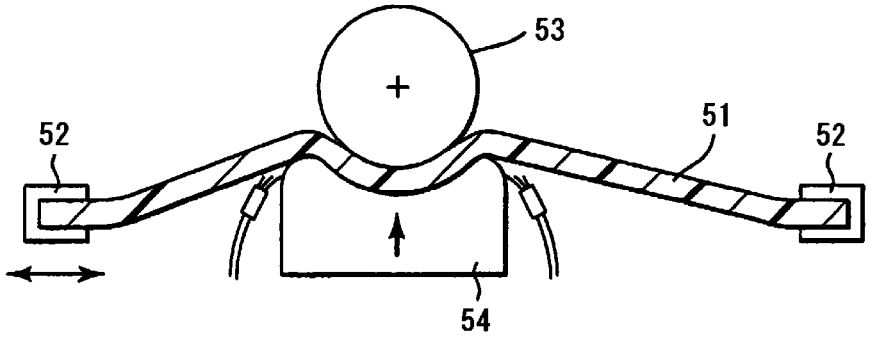
FIG. 5 shows a crack resistance tester.

Measurement was performed using an apparatus as shown in FIG. 5. Both sides of a test piece 51 were nipped with clamp hands 52 and 52. The clamp hands 52 and 52 could be interlocked to shuttle right and left. The tension applied to the test piece 51 was 3 kg/cm and the shuttling speed was 40 cm/second.

The test piece 51 was sandwiched between a rotating roller 53 and a press shoe 54, and was loaded with a pressure of 36 kg/cm.sup.2 by driving the press shoe toward the rotating roller.

The test apparatus shuttled repeatedly the test piece, and the number of times of shuttling was counted until the surface of the test piece 51 on the rotating roller side got cracked. The test result was evaluated by the following 4-stage scale.

Figure 6:
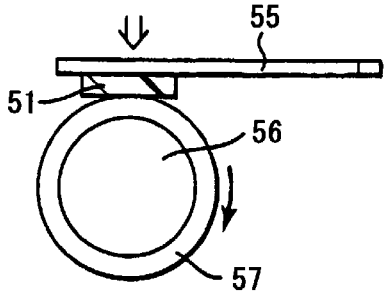
FIG. 6 shows an abrasion resistance tester.

Not less than 200,000 times: excellent 100,000 to 200,000 times: good 20,000 to 100,000 times: a little bad Not more than 20,000: bad Abrasion Resistance The abrasion resistance was measured by an apparatus shown in FIG. 6. In FIG. 6, a test piece 51 was attached to the back side of a press board 55, and the back surface of the test piece (the surface to be measured) was abutted against a rotating roller 56 to press. The rotating roller 56 was amounted with an abrasive block 57 on the outer circular surface, and gave friction on the test piece 51 at a rotation speed of 100 m/minute with a pressure of 6 kg/cm for 10 minutes. A loss in thickness of the test piece 51 after the test was measured. The test result was evaluated on the following 4-stage scale:

Not more than 0.05 mm of an abrasion loss: excellent 0.05 to 0.5 mm of an abrasion loss: good From 0.5 to 0.8 mm of an abrasion loss: a little bad Not less than 0.8 mm of an abrasion loss: bad

Examples 1 to 5 and Comparative Examples 1 to 5

Mixed Prepolymer

As urethane prepolymers on the shoe side and on the felt side, the mixed prepolymers of TDI prepolymer/MDI prepolymer having their respective molar ratios shown in Table 1 were used. Various belt samples were manufactured, and their physical properties of both the shoe side and the felt side were evaluated. The results are shown in Table 1.

TABLE 1

| | | shoe side | | | | | felt side | | | | |
|---|---|---|---|---|---|---|---|---|---|---|---|
| | | mixture of TDI prepolymer and MDI prepolymer | | | | | mixture of TDI prepolymer and MDI prepolymer | | | | |
| | | TDI content % by mole | MDI content % by mole | curing agent* | processability (liquid sag) | delamination | TDI content % by mole | MDI content % by mole | curing agent* | crack resistance | abrasion resistance |
| Example | 1 | 40 | 60 | DMTDA | good | good | 90 | 10 | DMTDA | good | good |
| | 2 | 30 | 70 | DMTDA | good | good | 90 | 10 | DMTDA | good | good |
| | 3 | 20 | 80 | DMTDA | good | good | 90 | 10 | DMTDA | good | good |
| | 4 | 40 | 60 | DMTDA | good | good | 95 | 5 | DMTDA | a little poor | good |
| | 5 | 40 | 60 | DMTDA | good | good | 50 | 50 | DMTDA | a little poor | a little poor |
| Comparative | 1 | 100 | 0 | DMTDA | poor | good | 100 | 0 | DMTDA | poor | excellent |
| Example | 2 | 50 | 50 | DMTDA | a little poor | a little poor | 90 | 10 | DMTDA | good | good |
| | 3 | 20 | 80 | DMTDA | good | good | 97 | 3 | DMTDA | poor | good |
| | 4 | 20 | 80 | DMTDA | good | good | 40 | 60 | DMTDA | excellent | poor |
| | 5 | 20 | 80 | MOCA | good | poor | 80 | 20 | DMTDA | excellent | good |

Examples 6 to 10 and Comparative Examples 6 to 11

Mixed Diisocyanate

Diisocyanates, which were starting materials for producing urethane prepolymers on the shoe side and on the felt side were mixed at their respective ratios shown in Table 2. Belt samples were manufactured, and their physical properties of both the shoe side and the felt side were evaluated. The results are shown in Table 2.

TABLE 2

| | | shoe side | | | | | felt side | | | | |
|---|---|---|---|---|---|---|---|---|---|---|---|
| | | prepolymer prepared from TDI/MDI mixture | | | | | prepolymer prepared from TDI/MDI mixture | | | | |
| | | TDI content % by mole | MDI content % by mole | curing agent* | processability (liquid sag) | delamination | TDI content % by mole | MDI content % by mole | curing agent* | crack resistance | abrasion resistance |
| Example | 6 | 40 | 60 | DMTDA | good | good | 90 | 10 | DMTDA | good | good |
| | 7 | 20 | 80 | DMTDA | good | good | 90 | 10 | DMTDA | good | good |
| | 8 | 10 | 90 | DMTDA | good | good | 90 | 10 | DMTDA | good | good |
| | 9 | 5 | 95 | DMTDA | good | good | 95 | 5 | DMTDA | excellent | good |
| | 10 | 2 | 98 | DMTDA | a little poor | good | 85 | 15 | DMTDA | a little poor | excellent |
| Comparative Example | 6 | 100 | 0 | DMTDA | poor | good | 100 | 0 | DMTDA | poor | excellent |
| | 7 | 0 | 100 | DMTDA | good | poor | 80 | 20 | DMTDA | good | good |
| | 8 | 50 | 50 | DMTDA | poor | good | 80 | 20 | DMTDA | good | good |
| | 9 | 10 | 90 | DMTDA | good | good | 98 | 2 | DMTDA | poor | excellent |
| | 10 | 10 | 90 | DMTDA | good | good | 40 | 60 | DMTDA | excellent | poor |
| | 11 | 10 | 90 | MOCA | good | poor | 80 | 20 | MOCA | a little poor | good |

*DMTDA: dimethylthiotolylenediamine MOCA: 4,4'-methylenebis-(2-chloroaniline)

As apparent from the results of Table 1, the shoe press belts (Examples 1 to 5) of the present invention, wherein the TDI prepolymer and the MDI prepolymer were mixed at such a ratio that the shoe side of the belt had a higher MDI molar content than the felt side of the belt and further the shoe side and the felt side had their MDI molar contents within their respective specific ranges, were good in processability, delamination of their shoe sides, crack resistance and abrasion resistance of their felt sides.

Also, as apparent form the results of Table 2, the shoe press belts (Examples 6 to 10) of the present invention, wherein mixed diisocyanates of TDI/MDI were used as diisocyanates used for starting materials for polyurethane-prepolymers, and the shoe side and the felt side had their MDI molar contents within their respective specific ranges, were good in processability, and generally good in delamination of their shoe sides, crack resistance and abrasion resistance of their felt sides because they were within ranges for their usability, though some belts showed a little bad. On the contrary, the belt, wherein TDI was used aloe on the shoe side (Comparative Example 6) or had a low MDI molar content on the shoe side (Comparative Example 8), was bad in processability; and the belt, wherein MDI was used alone on the shoe side (comparative Example 7), was susceptible to delamination. Further, the belt, wherein TDI was used alone on the felt side (Comparative Example 6) or had a low MDI molar content (Comparative Example 9), was poor in crack resistance; and the belt, wherein had a high MDI molar content on the felt side (Comparative Example 10), was poor in abrasion resistance.

INDUSTRIAL APPLICABILITY

The present invention provides a shoe press belt comprising a substrate and a polyurethane resin impregnated to laminate on the surfaces of both sides thereof, wherein, as the polyurethane resin, (1) a polyurethane resin obtained from a mixture of a TDI prepolymer which is obtained by reacting TDI with a polyol and an MDI prepolymer which is obtained by reacting MDI with a polyol, or (2) a polyurethane resin obtained from a urethane prepolymer which is obtained by reacting a TDI/MDI mixed diisocyanate as a starting material for producing a urethane prepolymer is used, and, in any of these embodiments the TDI prepolymer and the MDI prepolymer are mixed at such a ratio that the polyurethane resin on the shoe side has a higher MDI molar content than the polyurethane resin on the felt side. The shoe side has preferably an MDI molar content of 60 to 95%, particularly preferably 70 to 90%, while the felt side has preferably an MDI molar content of 5 to 50%, particularly preferably 10 to 40%, thereby to provide a shoe press belt which is excellent in crack resistance, abrasion resistance and processability.

Consequently, even if the belt works under a severe condition such as running at a high speed under a high pressure, the belt is not damaged by cracking and abrasion and is thus more durable and usable over a longer time period, which is expected to reduce-cost, to shorten downtime caused by replacement of the belt, and to improve productivity.

DESCRIPTION OF REFERENCE NUMERALS

10 belt
20 polyurethane
21 felt side resin.
22 shoe side resin
23 drainage groove
24 bottom part
25 land part
30 substrate
31 yarn material in MD direction
32 yarn material in CMD direction
40, 41 roller
42 resin coating nozzle
43 heat source
51 test piece
52 clamp hand
53 rotating roller
54 press shoe
55 press board
56 rotating roller
57 abrasive block

The invention claimed is:

1. A shoe press belt comprising:

a substrate having surfaces on a shoe side thereof and a felt side thereof; and a polyurethane resin impregnated and laminated on the surfaces of both the shoe side and the felt side of the substrate, wherein the polyurethane resin is obtained by reacting a mixed prepolymer with a dimethyl-thio-toluenediamine curing agent, wherein the mixed prepolymer consists of (1) a TDI prepolymer which is obtained by reacting a tolylene diisocyanate (TDI) with a polyol and has an isocyanate group at the end, and (2) an MDI prepolymer which is obtained by reacting diphenylmethane diisocyanate (MDI) with a polyol and has an isocyanate group at the end, wherein the TDI prepolymer and the MDI prepolymer are mixed at such a ratio that the polyurethane resin on the shoe side has an MDI molar content of 60 to 95% and the polyurethane resin on the felt side has an MDI molar content of 5 to 50%.

2. The shoe press belt according to claim 1, wherein the TDI prepolymer and the MDI prepolymer are mixed at such a ratio that the polyurethane resin on the shoe side has an MDI molar content of 70 to 90% and the polyurethane resin on the felt side has an MDI molar content of 10 to 40%.

3. The shoe press belt of claim 2, wherein a drainage groove is formed on a surface of the polyurethane resin on the felt side of the substrate.

4. The shoe press belt of claim 3, wherein the drainage groove has a rectangular cross section with a round bottom and chamfered land edges.

5. The shoe press belt according to claim 3, wherein the drainage groove has a trapezoidal cross section with a round bottom and chamfered land edges.

6. The shoe press belt according to claim 2, wherein the drainage groove has a width of 1 to 4 mm, a depth of 0.5 to 5 mm, and an interval of 1 to 4 mm between neighboring drainage grooves.

7. The shoe press belt of claim 1, wherein a drainage groove is formed on a surface of the polyurethane resin on the felt side of the substrate.

8. The shoe press belt of claim 7, wherein the drainage groove has a rectangular cross section with a round bottom and chamfered land edges.

9. The shoe press belt according to claim 7, wherein the drainage groove has a trapezoidal cross section with a round bottom and chamfered land edges.

10. The shoe press belt according to claim 1, wherein the drainage groove has a width of 1 to 4 mm, a depth of 0.5 to 5 mm, and an interval of 1 to 4 mm between neighboring drainage grooves.

11. A shoe press belt comprising:

a substrate having surfaces on a shoe side thereof and a felt side thereof; and a polyurethane resin impregnated and laminated on the surfaces of both the shoe side and the felt side of the substrate, wherein the polyurethane resin is obtained by reacting a urethane prepolymer with a dimethyl-thio-toluenediamine curing agent, wherein the urethane prepolmer is obtained by reacting a mixture of tolylene diisocyanate (TDI) and diphenylmethane diisocyanate (MDI) with a polyol and has an isocyanate group at the end, wherein the mixture of the TDI and the MDI is mixed at a ratio such that the polyurethane resin on the shoe side has mixed diisocyanate with an MDI molar content of 60 to 95% and the polyurethane resin on the felt side has mixed diisocyanate with an MDI molar content of 5 to 50%.

12. The shoe press belt according to claim 11, wherein the mixture of the TDI and the MDI is mixed at a ratio such that the polyurethane resin on the shoe side has mixed diisocyanate with an MDI molar content of 70 to 90% and the polyurethane resin on the felt side has mixed diisocyanate with an MDI molar content of 10 to 40%.

13. The shoe press belt of claim 12, wherein a drainage groove is formed on a surface of the polyurethane resin on the felt side of the substrate.

14. The shoe press belt of claim 13, wherein the drainage groove has a rectangular cross section with a round bottom and chamfered land edges.

15. The shoe press belt according to claim 13, wherein the drainage groove has a trapezoidal cross section with a round bottom and chamfered land edges.

16. The shoe press belt according to claim 12, wherein the drainage groove has a width of 1 to 4 mm, a depth of 0.5 to 5 mm, and an interval of 1 to 4 mm between neighboring drainage grooves.

17. The shoe press belt of claim 11, wherein a drainage groove is formed on a surface of the polyurethane resin on the felt side of the substrate.

18. The shoe press belt of claim 17, wherein the drainage groove has a rectangular cross section with a round bottom and chamfered land edges.

19. The shoe press belt according to claim 17, wherein the drainage groove has a trapezoidal cross section with a round bottom and chamfered land edges.

20. The shoe press belt according to claim 11, wherein the drainage groove has a width of 1 to 4 mm, a depth of 0.5 to 5 mm, and an interval of 1 to 4 mm between neighboring drainage grooves.

* * * * *